US005177394A

United States Patent [19]

Kubo

[11] Patent Number: 5,177,394

[45] Date of Patent: Jan. 5, 1993

[54] CONDUCTION COOLING TYPE MULTISTAGE COLLECTOR

[75] Inventor: Hideichi Kubo, Tokyo, Japan

[73] Assignee: NEC Corporation, Tokyo, Japan

[21] Appl. No.: 734,583

[22] Filed: Jul. 23, 1991

[30] Foreign Application Priority Data

Jul. 26, 1990 [JP] Japan ..... 2-198912

[51] Int. Cl.[5] ..... H01J 61/52; H01J 7/24

[52] U.S. Cl. ..... 313/39; 313/46; 315/5.38; 165/104.33

[58] Field of Search ..... 313/39, 46; 315/5.38; 165/104.33

[56] References Cited

U.S. PATENT DOCUMENTS 3,666,980 5/1972 Jackson ..... 313/39

4,504,762 3/1985 Hart et al. ..... 313/46 X

*Primary Examiner*—Donald J. Yusko

*Assistant Examiner*—Ashok Patel

*Attorney, Agent, or Firm*—Laff, Whitesel, Conte & Saret

[57] ABSTRACT

Disclosed is a conduction cooling type multistage collector for use in an electron beam tube in which a plurality of collector electrodes are electrically insulated with insulators, wherein one collector electrode is brazed on the inner surface of one ring-shaped insulator and a metal cylinder is brazed on the end portion of the insulator, whereby a vacuum envelope is formed. The collector has high electric insulation properties and excellent radiation effect.

2 Claims, 2 Drawing Sheets

CONDUCTION COOLING TYPE MULTISTAGE COLLECTOR

BACKGROUND OF THE INVENTION

1. Field of the Invention

This invention relates to an improvement of a conduction cooling type multistage collector for use in an electron beam tube such as a traveling wave tube or the like.

2. Description of the Prior Art

A collector for a traveling wave tube recovers a heat from an electron beam which results from an interaction of a high frequency wave in a slow-wave circuit. When the electron beam strikes against the collector, the kinetic energy which the electron possesses is converted to heat. As a result the collector reaches a high temperature. A multistage collector functions as a means for reducing the energy generated at this time to be as little as possible and for heightening an efficiency in the traveling wave tube.

The stage number of the collector to be adopted is generally 2 to 4 because of weight of the traveling wave tube and complication of the power source thereof. Also, a method of enabling an escape of the heat generated in the collector includes a natural air cooling, forced air cooling, conduction cooling or radiation cooling method or the like. In the case that the energy generated in the collector is relatively as small as several tens of Watts, the conduction cooling type is adopted.

FIG. 1 is a sectional view of a first embodiment of the prior conduction cooling type multistage collector, wherein the stage number of the collector is three. Three collector electrodes are in order arranged as the first, second and third collector electrodes 2, 3 and 4 from near a slow-wave circuit 1, said collector electrodes being electrically insulated with insulators 9, i.e. insulating porcelain 9 and the highest applied voltage being applied to the first collector electrode 2 and the gradually decreased applied voltage being applied to the second and third collector electrodes. Among the electron beams of which the interaction with the high frequency signal in the slow-wave circuit was completed, the slow speed electrons are caught with the first collector electrode 2 having the highest voltage and the high speed electrons are jumped in the innermost third collector electrode 4 with force. When the electrons impact on the collector electrodes, heat is generated. The heat generated in the collector electrodes is conducted through a cylindrical insulator 10 to a radiating block or heat dissipation block 7 and further to a base plate 8, in FIG. 1.

FIG. 2 shows a sectional view of a second embodiment of the prior collector structure wherein ring-shaped insulators 6 are in position held inside a metal vacuum envelope 11 and further collector electrodes 2, 3 and 4 are brazed inside the ring-shaped insulators 6.

FIG. 3 shows a sectional view of a third embodiment of the prior collector structure wherein first, second and third collector electrodes 2, 3 and 4 are mounted inside an integral insulator 12 with brazing. In this structure, there have been advantages that the collector is simple in the structure and is light-weight. However, there has been a risk that some problem in insulation is caused, since it is impossible to establish raised portions along the creeping surface of the insulating porcelain between the slow-wave circuit 1 and the first collector electrode 2 or between the first collector electrode 2 and the second collector electrode 3 and between the second collector electrode 3 and the third collector electrode 4.

In the structure of the first embodiment of FIG. 1 among the three prior structures as mentioned above, an insulation treatment became complicated since the collector electrodes form the vacuum envelope. In addition, since contacts between the collector electrodes and the cylindrical insulators and between the cylindrical insulators and the radiating block were mechanically made, there was a risk that heat resistance becomes easily high and thus the temperature rise in the collectors is caused. Also, in the structure of the second embodiment of FIG. 2, the insulation could be easily made but, with regard to heat dissipation, there was a defect that the ring-shaped insulator and the metal vacuum envelope cannot be directly brazed because of escaping the heat stress and thus the heat resistance becomes high at the portion. Moreover, in the third embodiment as shown in FIG. 3, since it is impossible to establish the raised portions along the creeping surface of the insulating porcelain between the collector electrodes, there was a risk that some problem in insulation is caused and there was a defect that the collector becomes large when trying to obtain sufficient insulation pressure resistance in direction of the axis.

SUMMARY OF THE INVENTION

It is an object of this invention to provide a conduction cooling type multistage collector wherein the defects of the prior structure as mentioned above are obviated and which has high electric insulation properties and excellent radiation effect.

The above object is accomplished by a conduction cooling type multistage collector for use in an electron beam tube in which a plurality of collector electrodes are electrically insulated with insulators, wherein one collector electrode is brazed on the inner surface of one ring-shaped insulator and a metal cylinder is brazed on the end portion of the insulator, whereby a vacuum envelope is formed, and further on the end portion of the insulator, at least one raised portion may be established along the circumference of a circle thereof.

BRIEF DESCRIPTION OF THE DRAWINGS

By way of example of the many features and advantages of the invention, an illustrative embodiment in the conduction cooling type multistage collector is described below and shown in the accompanying drawings, in which.

DETAILED DESCRIPTION OF THE PREFERRED EMBODIMENT

In the conduction cooling type multistage collector of this invention, the ring-shaped insulators are concentrically brazed on the outer peripheral surface of the collector electrodes in a one-to-one correspondence therebetween, i.e. in such a manner that one ring-shaped insulator is concentrically brazed on the outer peripheral surface of one collector electrode, and the metal cylinder is brazed on the end portion of the ring-shaped insulator, whereby the vacuum envelope is formed. The outer peripheral surface of the ring-shaped insulator is directly contacted with the heat dissipation block to improve the heat conduction. In addition, on the end or ends of the ring-shaped insulator, at least one raised portion may be established over the circumference of a circle thereof in order to lengthen a lengthwise creeping distance.

EXAMPLE

Next, this invention will be described with reference to the accompanying drawing.

Figure 1:
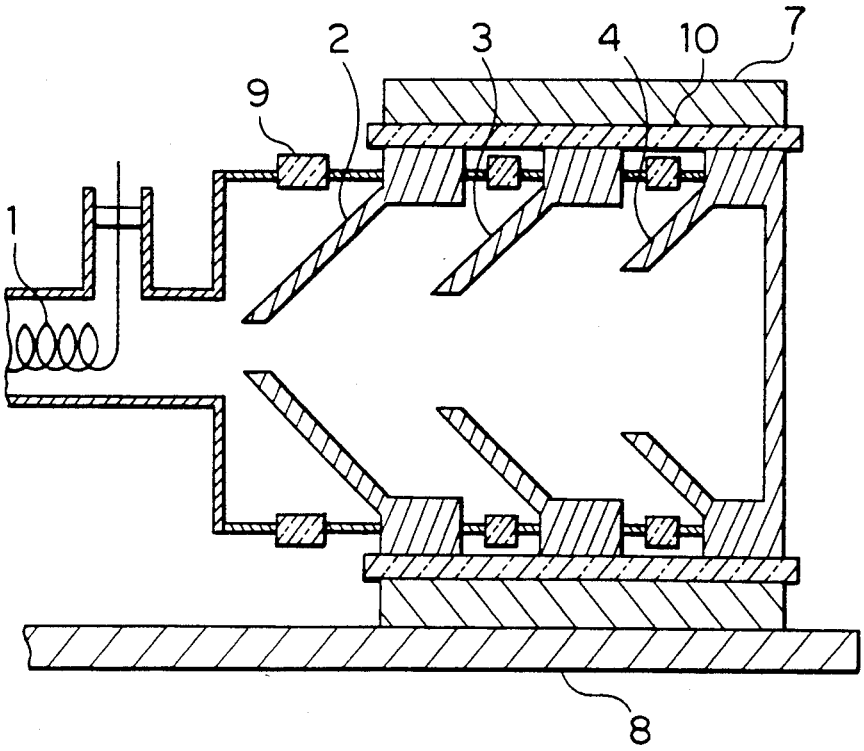
FIG. 1 shows a sectional view of the collector according to the prior structure.
Figure 2:
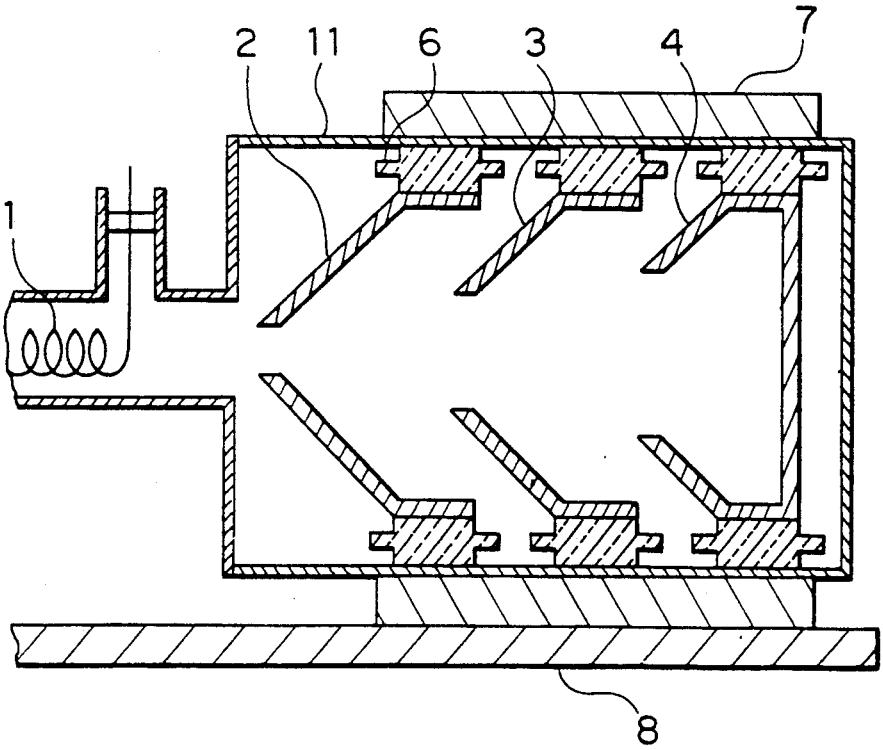
FIG. 2 shows a sectional view of the collector according to the prior structure.
Figure 3:
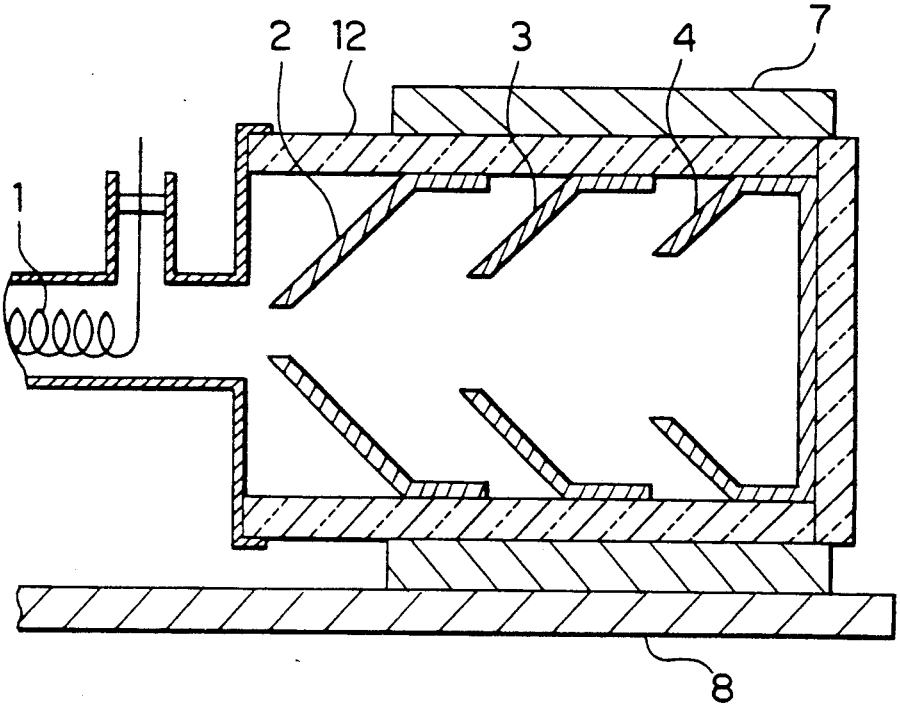
FIG. 3 shows a sectional view of the collector according to the prior structure.
Figure 4:
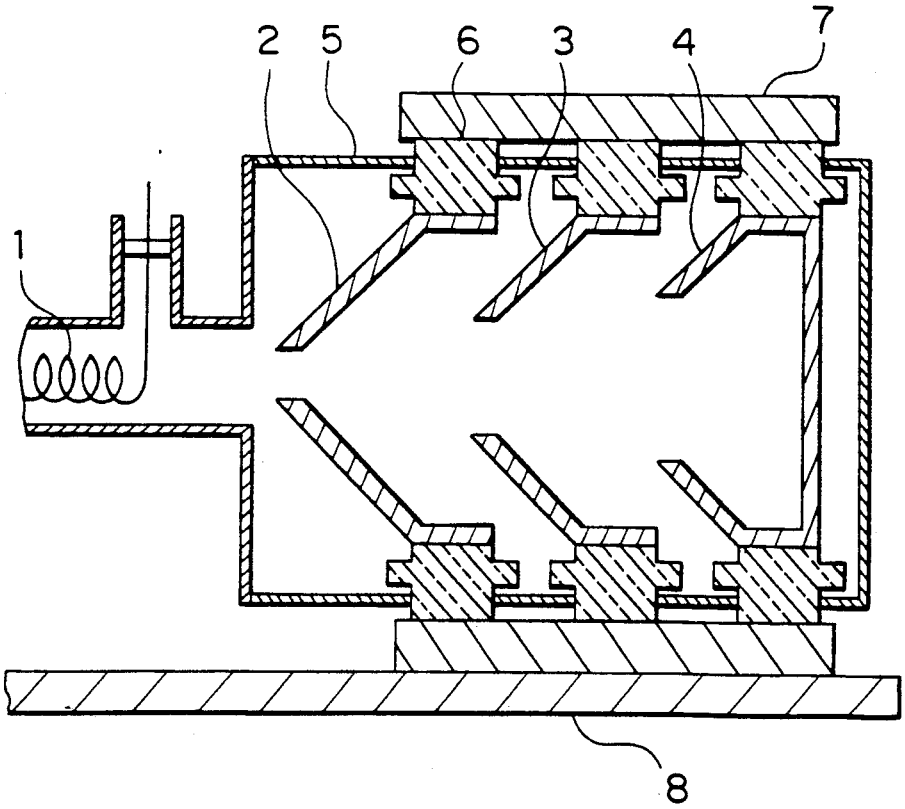
FIG. 4 shows a sectional view of one embodiment according to this invention.

FIG. 4 shows a sectional view in an axial direction of a three-stage collector according to one embodiment of this invention. The first collector electrode 2, the second collector electrode 3 and the third collector electrode 4 were in order arranged from near the slow-wave circuit 1. Each of the collector electrodes was set on the inner peripheral surface of each of the ring-shaped insulators 6 with brazing. The collector electrode was made of molybdenum and the ring-shaped insulator was made of an alumina ceramic. On the ends of the ring-shaped insulators 6, the metal cylinders 5 were brazed to form the vacuum envelope. The heat dissipation block 7 were contacted with the outer peripheral surfaces of the ring-shaped insulators 6 on which each of the collector electrodes was brazed, whereby the heat generated in the collector electrodes was dissipated outside. Also, on the ends of the ring-shaped insulators, the raised portions were established over the circumference of a circle thereof, whereby the radial creeping distance was lengthened and the insulation was improved.

As mentioned above, in accordance with this invention, one ring-shaped insulator is brazed on one collector electrode and thus the insulation between the collector electrodes can be sufficiently made. Also, the heat generated in the collector electrodes is directly conducted through the ring-shaped insulators to the heat dissipation block, and thus it becomes possible to improve the heat dissipation. Moreover, the collector of this invention has a practical value that the assembly and manufacture thereof are easy and simple as compared with those of the prior collector.

What is claimed is:

1. A conduction cooling type multistage collector for use in an electron beam tube in which a plurality of collector electrodes are electrically insulated with insulators, wherein each collector electrode is brazed on an inner surface of an individually associated ring-shaped insulator, a metal cylinder is brazed on an end portion of each of the insulators to form a vacuum envelope surrounding said collector electrodes and parts of said insulators, an opposite end portion of each of the ring-shaped insulators is further extended outwardly through a wall of said metal cylinder, and a heat dissipating block outside said vacuum envelope is connected directly to said opposite end portions of said ring shaped insulators for drawing heat from said electron beam tube.

2. A conduction cooling type three-stage collector for use in an electron beam tube including three collector electrodes electrically insulated with insulators and having a heat dissipating block, wherein each collector electrode is made of molybdenum and is brazed on an inner surface of a individually associated ring-shaped insulator made of an alumina ceramic, a metal cylinder is brazed on an end portion of each of said insulators to form a vacuum envelope, said heat dissipation block is connected directly to outer surfaces of said ring-shaped insulators for drawing heat from said electron beam tube, and the end portions of each of said ring-shaped insulators is extended outwardly through said metal cylinder.

* * * * *